US005197248A

United States Patent [19]

Kruse

[11] Patent Number: 5,197,248

[45] Date of Patent: Mar. 30, 1993

[54] PREFABRICATED COLUMN ASSEMBLY

[75] Inventor: George D. Kruse, Folsom, Calif.

[73] Assignee: PPA Industries, Inc., Dallas, Tex.

[21] Appl. No.: 945,154

[22] Filed: Sep. 15, 1992

[51] Int. Cl.[5] ..... E04C 1/00

[52] U.S. Cl. ..... 52/309.4; 52/309.7; 52/309.12

[58] Field of Search ..... 52/300, 309.9, 309.11, 52/309.16, 309.17, 727, 309.12

[56] References Cited

U.S. PATENT DOCUMENTS

| | | | |
|---|---|---|---|
| 2,664,740 | 1/1954 | Cochrane . | |
| 2,708,494 | 5/1955 | Larsen . | |
| 3,332,170 | 7/1967 | Bangs | 52/727 X |
| 3,416,277 | 12/1968 | Wood et al. | 52/300 |
| 3,828,502 | 8/1974 | Carlsson | 52/309.11 |
| 4,193,584 | 3/1980 | Wieser . | |
| 4,226,067 | 10/1980 | Artzer . | |
| 4,297,820 | 11/1981 | Artzer . | |
| 4,336,676 | 6/1982 | Artzer . | |
| 4,364,546 | 12/1982 | Lyman et al. . | |
| 4,601,146 | 7/1986 | Harter et al. . | |
| 4,614,013 | 9/1986 | Stevenson . | |
| 4,719,731 | 1/1988 | Ravotti et al. . | |
| 4,730,428 | 3/1988 | Head et al. | 52/309.11 |
| 4,754,587 | 7/1988 | Glaser | 52/309.11 X |
| 4,862,660 | 9/1989 | Raymond | 52/309.11 X |
| 4,883,256 | 11/1989 | Hebda . | |
| 4,898,365 | 2/1990 | Conner et al. . | |
| 4,930,752 | 6/1990 | Wolper, Jr. . | |

*Primary Examiner*—Carl D. Friedman
*Assistant Examiner*—Creighton Smith
*Attorney, Agent, or Firm*—Lee, Mann, Smith, McWilliams, Sweeney & Ohlson

[57] ABSTRACT

A prefabricated wall enclosure column assembly for supporting various types of articles comprising a tube which is placed over and around a support post. The tube comprises a wire frame having an interior wire grid and an exterior wire grid and a filler material disposed between the wire grids. Metal strips are located in the wall of the tube on opposing sides of the tube to provide a mounting mechanism. A rigid coating comprising a cementitious material is applied to the exterior wire grid of the frame. The rigid coating is embedded with and reinforced by a plurality of fiberglass filaments. A vinyl acrylic coating is placed over the rigid coating to provide a durable outer surface. The articles to be supported may be attached to the exterior surface of the tube by fasteners which are connectable to the mounting strips. Alternatively, a plurality of apertures may be cut through the wall of the tube and mounting plates may be inserted into each aperture and fastened to the support post. The article to be supported may be connected to the mounting plates by fasteners whereby the load from the supported article will be transferred directly to the post without applying any load to the tube.

12 Claims, 3 Drawing Sheets

PREFABRICATED COLUMN ASSEMBLY

BACKGROUND OF THE INVENTION

The present invention relates to prefabricated column assembly systems and in particular to prefabricated exterior column assembly systems which are light-weight and erected by hand without the use of lifting devices.

Exterior enclosure systems such as fences generally include a plurality of spaced apart support posts or columns which are interconnected by fence panels. Fence support columns typically include either a single pipe support as commonly used with chain-link fence fabric and with prefabricated panel enclosure systems as described in U.S. patent application Ser. No. 07/790,496 filed Nov. 12, 1991, or masonry columns made of materials such as brick, stone or concrete. While pipe support posts offer the advantages of being easily and quickly installed by hand with a minimum amount of labor and without the need for any lifting devices such as cranes or hoists, masonry wall enclosure systems require a large amount of time and labor to construct and generally are very heavy requiring substantial footings to provide support for the masonry columns. While masonry columns are often generally more expensive to install as part of an exterior enclosure system, masonry columns are often preferred as they provide a more pleasing aesthetic appearance than pipe support posts and are generally more stable. There has therefore been a need for a wall enclosure support column which provides the aesthetic and stability advantages of masonry columns, but which also provides the advantages of being light-weight and prefabricated so that the enclosure support column may be easily and quickly installed by hand with a minimum amount of labor.

SUMMARY OF THE INVENTION

The present invention provides a prefabricated wall enclosure column assembly for supporting various types of articles such as fence panels, gates, lighting fixtures, signs and the like. The column assembly comprises a tube having an interior surface and an exterior surface. The interior surface of the tube defines an axial bore extending through the tube. The tube comprises a wire frame having an interior wire grid and an exterior wire grid. Filler material is disposed between the interior and exterior wire grids of the frame. Galvanized steel strips are located in the wall of the tube on opposing sides of the tube to provide a mounting mechanism. A rigid coating comprising a cementitous material such as stucco is applied to the exterior wire grid of the frame. The rigid coating is embedded with and reinforced by a plurality of fiberglass filaments and may be provided with various different surface textures as desired. A vinyl acrylic coating is placed over the rigid coating to provide a tough durable outer surface. Brick or stone laminates or veneers may be applied to the exterior surface of the tube. The tube is placed over and around a support post. The support post may comprise a single pipe or a pair of spaced apart and parallel pipes joined to one another.

The articles to be supported may be attached to the column in two different ways. The articles to be supported may be attached to the exterior surface of the tube by fasteners such as self-drilling, self-tapping screws, bolts or other well known fastener means which are connectable to the mounting strips. In this arrangement the load from the article connected to the mounting strips will be supported by the tube of the column assembly.

Alternatively, a plurality of apertures may be cut through the wall of the tube in areas where there are no support strips. A mounting plate is inserted into each aperture and is fastened to the support post by a threaded rod and nuts. The article to be supported is connected to the mounting plates by fasteners such as self-drilling, self-tapping screws, bolts or welding whereby the load from the supported article will be transferred to the mounting plates and then to the support post without applying any load to the tube of the column assembly.

DESCRIPTION OF THE PREFERRED EMBODIMENTS

Figure 2:
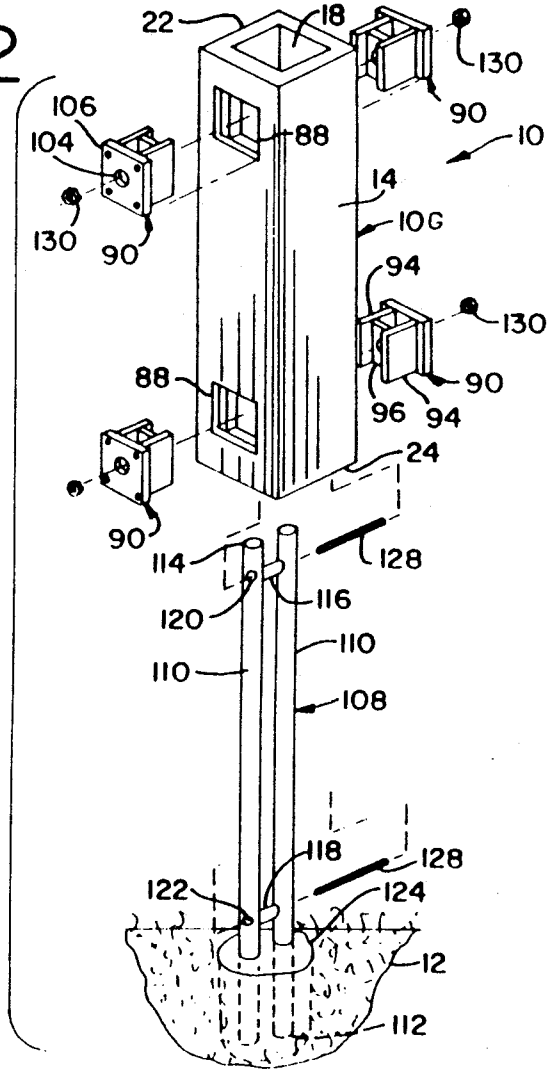
FIG. 2 is an exploded view of the prefabricated wall enclosure column assembly.
Figure 1:
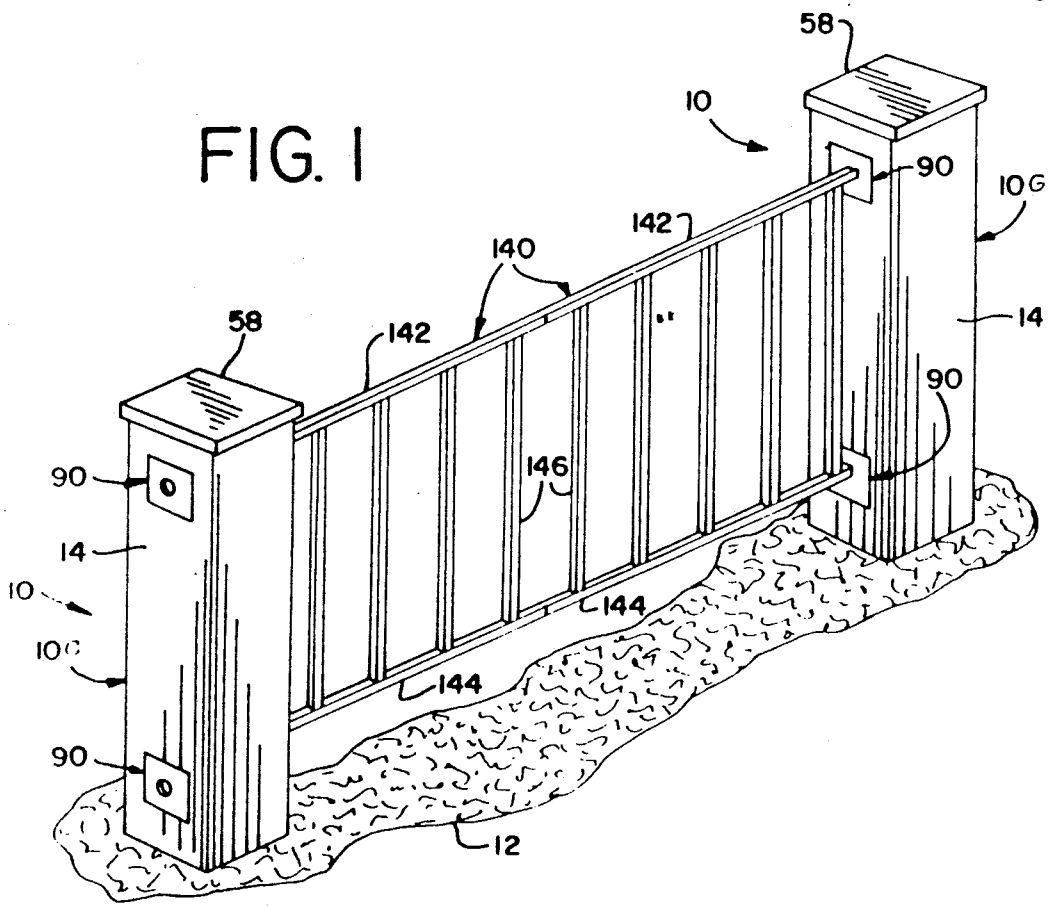
FIG. 1 is a perspective view of the prefabricated wall enclosure column assembly showing two column assemblies each supporting a gate.
Figure 3:
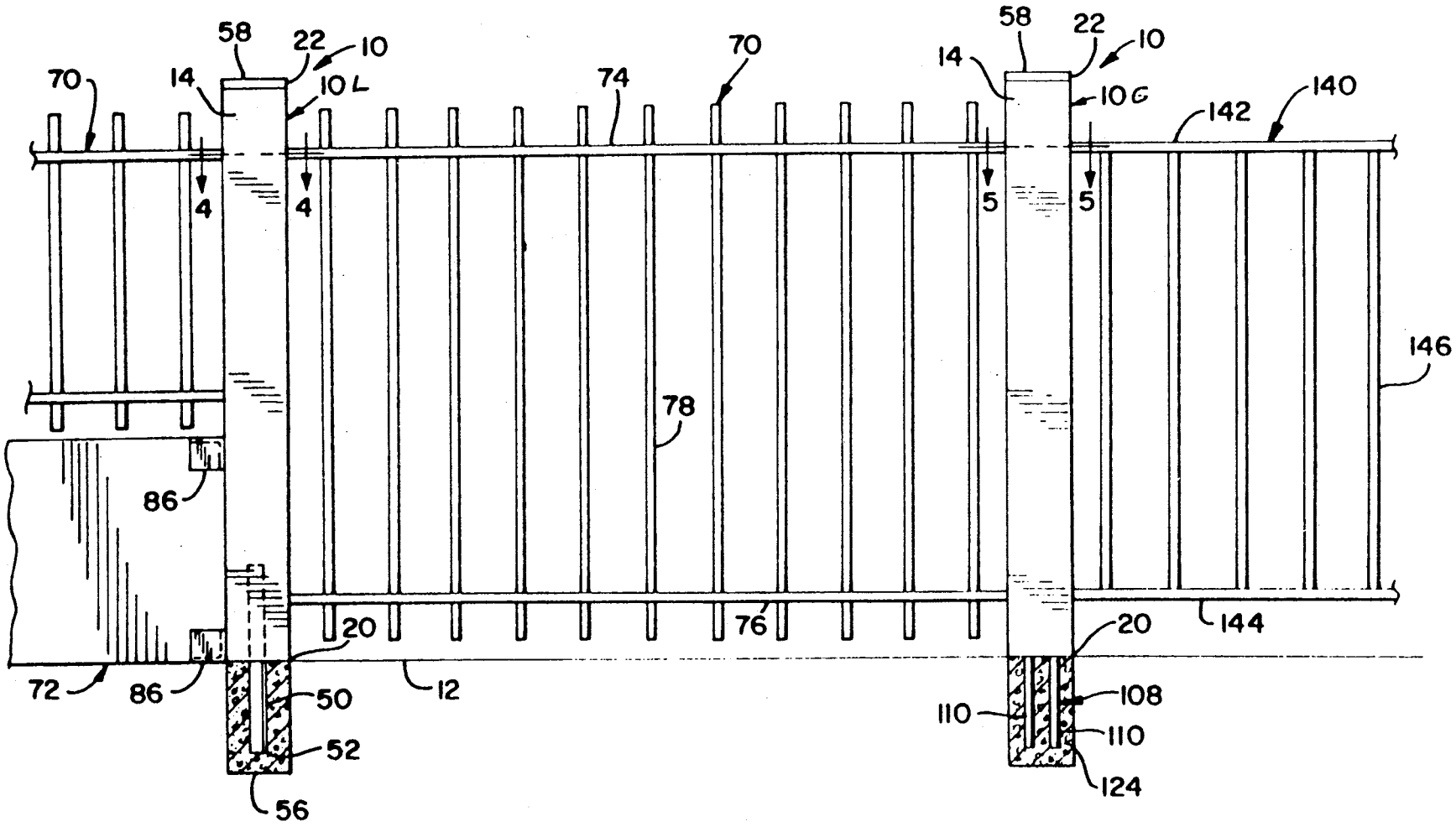
FIG. 3 is a side elevational view of two prefabricated wall enclosure column assemblies shown supporting various types of articles.
Figure 4:
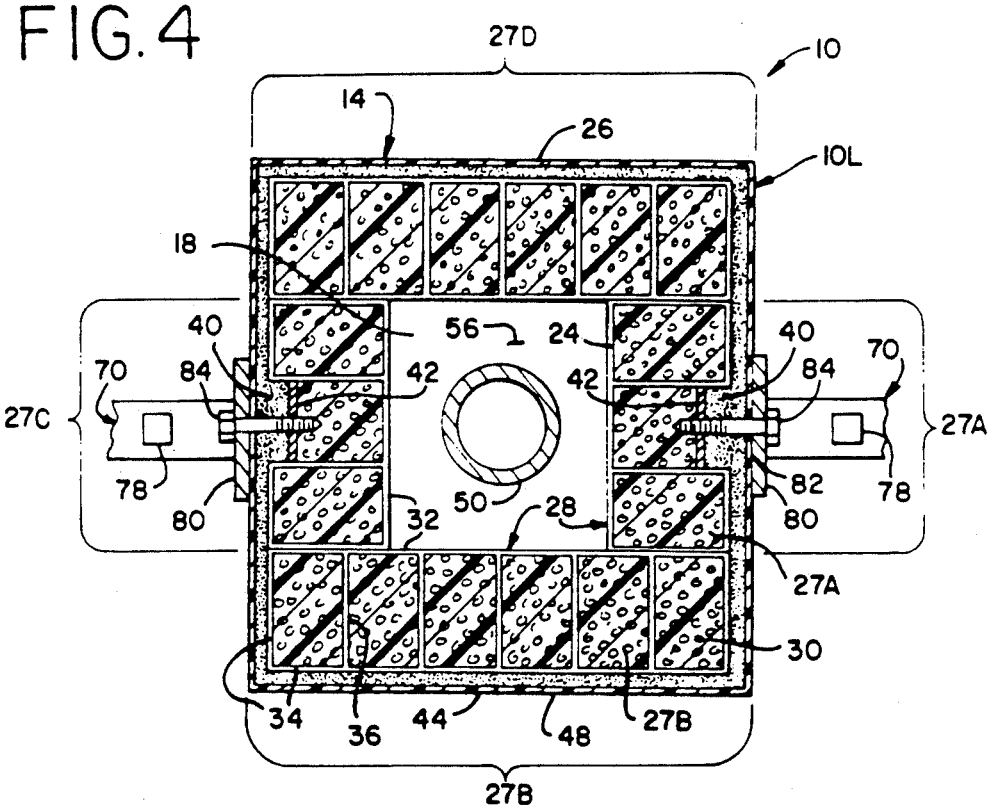
FIG. 4 is a cross sectional view taken along lines 4—4 of FIG. 3.
Figure 5:
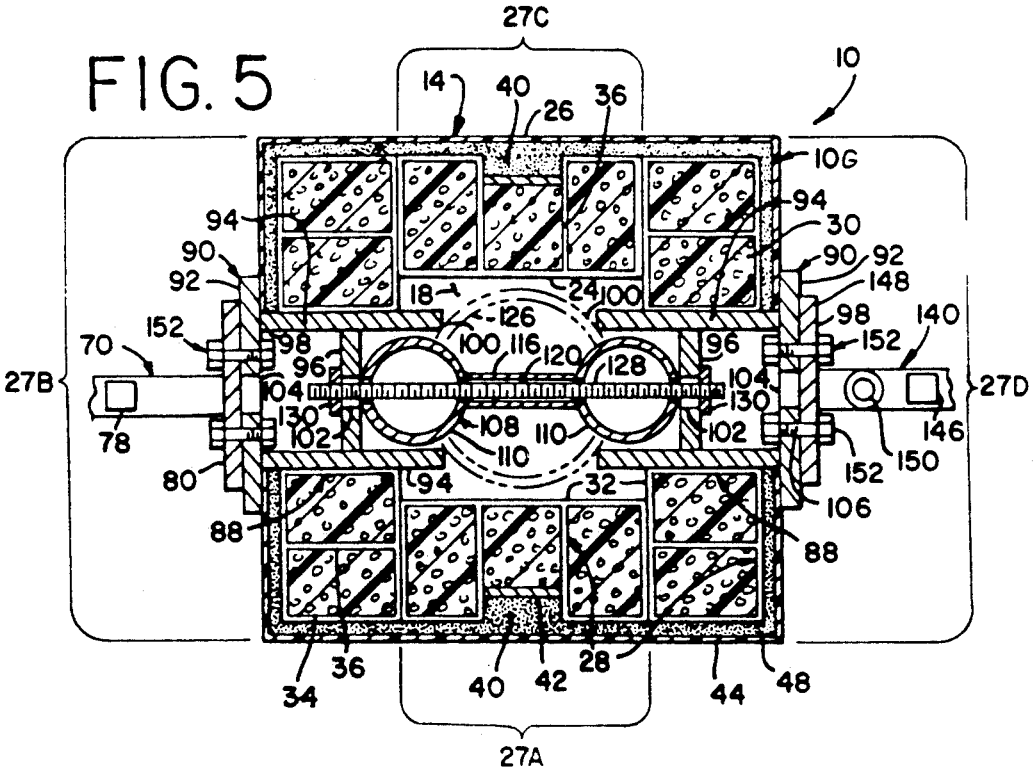
FIG. 5 is a cross sectional view taken along lines 5—5 of FIG. 3.

FIGS. 1 and 3 show several prefabricated wall enclosure column assemblies 10 supported by the ground 12. A column assembly 10 may be used as a line column 10L as shown by the left hand column assembly 10 in FIG. 3 and as shown in FIG. 4, or as a gate column 10G as shown in FIGS. 1, 2 and 5, and by the right hand column assembly 10 in FIG. 3. As best shown in FIGS. 3 and 4, the line column 10L includes a tube 14. The tube 14 defines an axial bore 18 extending through the tube 14 between a bottom end 20 and a top end 22. The tube 14 includes an interior surface 24 and an exterior surface 26.

The tube 14 includes a plurality of side wall portions 27A–D. Each side wall portion 27A–D includes a three-dimensional welded wire frame 28 and filler material 30 located within the frame 28. The filler material 30 may be provided in the form of elongate rectangular blocks as shown in FIGS. 4 and 5 or may be provided in various other well known forms. The wire frame 28 includes an interior rectangular wire grid 32 and an exterior rectangular wire grid 34 which is spaced apart and parallel to the interior rectangular wire grid 32. A plurality of bent-wire web members 36 are attached to and extend between the wire grids 32 and 34. The filler material 30 is located between the wire grids 32 and 34 and the web members 36. The wire frame 28 is preferably made of galvanized or aluminized steel and the filler material 30 is preferably made of polystyrene. The side wall portion 27A and the opposing side wall portion 27C each include an odd number of cells formed between the wire grids 32 and 34 and between adjacent web members 36. The side wall portion 27B and the opposing side wall portion 27D each contain an even number of cells. The side wall portions 27A–D are arranged side by side in a rectangular pattern and are connected to one another along their sides by galvanized steel clips (not shown) which attach between the wire frames 28 of the adjacent wall portions 27A–D.

The filler material 30 in the center cell of the side wall portions 27A and 27C is located adjacent the interior wire grid 32 and the web members 36 and is spaced apart from the exterior wire grid 34 thereby forming a pocket 40 in each side wall portion 27A and 27C which extends the height of the tube 14 between the ends 20 and 22. A mounting strip 42 is located within each pocket 40 adjacent the filler material 30 and extends the height of the tube 14 between the ends 20 and 22. While each mounting strip 42 located in each pocket 40 preferably extends from the bottom end 20 to the top end 22 of the tube 14 in a unitary piece, a plurality of mounting strips 42 may be located in each pocket 40 which extend the height of the tube 14, or a plurality of spaced apart mounting strips 42 may be located within each pocket 40 which are spaced apart along the height of the tube 14. The mounting strip 42 is preferably a twenty gage galvanized steel strip $1\frac{3}{4}$ inches wide. The pockets 40 are preferably approximately one-quarter inch deep.

A rigid coating 44 is applied over the exterior wire grid 34 and over the exterior of the filler material 30 of the side wall portions 27A–D. The rigid coating 44 fills the pockets 40 in the tube 14. A plurality of fiberglass reinforcing filaments are dispersed throughout and embedded within the rigid coating 44. The rigid coating 44 is preferably a cementitous coating such as a lightweight polymer based stucco sold under the trademark FLEXI-ROCK by Flexi-Rock, Inc. in Tempe, Ariz. Other types of coatings 44 may be used as desired, however, they should preferably be light-weight and durable.

A surface coating 48 is applied over the rigid coating 44 by spraying or other well known application means. The surface coating 48 is preferably a vinyl acrylic coating sold under the trademark TRIKO-PLEX by Triko Industries, Inc. in Mesquite, Tex. The surface coating 48 provides the tube 14 with a flexible, long-lasting, mildew resistant outer surface. The surface coating 48 may be applied in various different colors as desired. The rigid coating 44 and surface coating 48 may be provided with various different surface finishes. Brick or stone veneer (not shown) may be applied to the exterior surface 26 of the tube 14 over the surface coating 48.

As shown in FIGS. 3 and 4, the tube 14 of the line column 10L is secured in an upright position by a support post 50. The support post 50 includes a lower end 52 and an upper end 54. The support post 50 is preferably made of a $2\frac{7}{8}$ inch outside diameter pipe. As shown in FIG. 3, the support post 50 has its lower end 52 embedded in a concrete footing 56. The lower end 52 of the support post 50 preferably extends approximately two feet below the surface of the ground 12 and the upper end 54 of the support post 50 preferably extends approximately two feet above the surface of the ground 12. A cap 58 is located on the top end 22 of the tube 14 to seal the bore 18.

Various types of articles such as fence panels 70 or wall panels 72 may be attached to the tube 14 of line column 10L as shown in FIG. 3. In addition, various different types of articles which are not shown such as lighting fixtures and signs, may also be attached to the tube 14 of the line column 10L. As shown in FIG. 3, the fence panel 70 includes an upper rail 74 and a lower rail 76 spaced apart and parallel to the upper rail 74. A plurality of pickets 78 extend vertically between the upper rail 74 and the lower rail 76 parallel and spaced apart from one another. As best shown in FIG. 4, a vertically oriented plate 80 is attached to the end of each upper rail 74 and lower rail 76. The plate 80 includes one or more apertures 82. A fastener 84 such as a self-drilling, self-tapping screw is installed through the aperture 82, through the coatings 44 and 48 of the tube 14, and threadably engages the mounting strip 42 for securement of the panel to the column assembly. Other types of arrangements for fastening gates or panels to the mounting strip 42 of the tube 14 may be used as desired.

Wall panels 72, such as those described in U.S. patent application Ser. No. 07/790,496, filed Nov. 12, 1991, or which may be made of wood or other materials, may also be attached to the tube 14 of the line column 10L as shown in FIG. 3. The wall panel 72 is attached to the tube 14 by brackets 86 located at each corner of the wall panel 72. The brackets 86 are attached to the tube 14 by the fasteners 84 in the same manner as are the fence panels 70. As shown in FIG. 3, a wall panel 72 and a fence panel 70 may be used in conjunction with one another, both being attached to the same side of the line column 10L. The articles to be supported by the line column 10L may be attached to the tube 14 at any location along the height of the tube 14 between the ends 20 and 22.

The line column 10L is installed by initially boring a hole in the ground 12. The hole is filled with concrete and the lower end 52 of the support post 50 is inserted into the concrete which forms the concrete footing 56. The bottom end 20 of the tube 14 is placed over the upper end 54 of the support post 50 and is located on top of the footing 56 with the upper end 54 of the support post 50 being located in the bore 18 of the tube 14. Concrete is then poured into the bore 18 at the top end 22 of the tube 14 to cover the upper end 54 of the support post 50. Once the concrete has sufficiently hardened, various articles such as the fence panels 70 and the wall panels 72 may be attached to the tube 14 by the fasteners 84. The fastener 84 passes through the aperture 82 in the plate 80, drills holes through the surface coating 48, the fiberglass reinforcement fabric 46, the rigid coating 44 and the mounting strip 42. The fastener 84 also taps threads into the mounting strip 42 such that the fastener 84 is threadably engaged to the mounting strip 42.

The rigid coating 44 located in the pocket 40 and between the mounting strip 42 and the plate 80 is placed into compression by the fastener 84. The exterior wire grid 34 of the frame 28 is located between the mounting strip 42 and the plate 80. This construction provides a strong and secure connection of the fence panel 70, wall panel 72 or other article to the tube 14. The loads applied by the fence panel 70, wall panel 72 or other articles which are attached to the tube 14 will be transferred from the article to the tube 14 by the fasteners 84. The tube 14 will then transfer these loads to the support post 50 and then to the footing 56.

Use of the tube 14 in a line column configuration, wherein the articles to be supported are attached to the mounting strips 42, is intended where the loads placed upon the tube 14 will primarily be vertical dead loads with small horizontal or torsional loads. Where the column assembly 10 will be subjected to very large dead loads or substantial horizontal or torsional loads, additional support may be desirable. A gate column assembly 10G for this purpose is shown in FIGS. 1–3 and 5.

The gate column 10G includes the same tube 14 as used in the line column 10L. When the tube 14 is used as a part of the gate column 10G, the mounting strips 42 and the pockets 40 may be eliminated, however, this is not necessary. As best shown in FIGS. 2 and 5, rectangular apertures 88 are cut through the wall of the tube 14 in the side wall portions 27B and 27D. The apertures 88 are located to extend through the center cells in the wall portions 27B and 27D. The apertures 88 may be located along the height of the tube 14 in any position as desired and may be cut by hand in the field at the job site.

The gate column 10G also includes a plurality of mounting fixtures 90. Each mounting fixture 90 includes a mounting plate 92, two side plates 94 and a center plate 96. Each side plate 94 extends between a first edge 98 and a second edge 100. The first edge 98 of the side plate 94 is connected to the mounting plate 92 such that the side plate 94 is perpendicular to the mounting plate 92. The side plates 94 of each mounting plate 92 are spaced apart and parallel to one another. The center plate 96 extends between and is attached to the side plates 94 and is spaced apart from and parallel to the mounting plate 92. The center plate 96 includes a central aperture 102 having a first diameter. The mounting plate 92 includes a central aperture 104 having a second diameter which is larger than the diameter of the aperture 102 and which is concentrically aligned with the aperture 102. The mounting plate 92 also includes a plurality of apertures 106 located around the aperture 104. As best shown in FIG. 5, the side plates 94 are spaced apart to fit closely within the apertures 88 in the wall of the tube 14. The mounting plate 92 is larger than the aperture 88 and is located adjacent the exterior surface 26 of the tube 14 covering the aperture 88.

The gate column 10G also includes a support post 108 best shown in FIG. 2. The support post 108 includes two parallel and spaced apart pipes 110. Each pipe 110 extends between a bottom end 112 and a top end 114. An upper cross pipe 116 extends perpendicularly between and is connected to the pipes 110. A lower cross pipe 118 extends perpendicularly between the pipes 110 and is attached thereto below the upper cross pipe 116. A bore 120 extends through the upper cross pipe 116 and the pipes 110 and a bore 122 extends through the lower cross pipe 118 and the pipes 110. The bottom ends 112 of the pipes 110 are set in a concrete footing 124 located in the ground 12. The location of the upper cross pipe 116 and the lower cross pipe 118 in relation to the surface of the ground 12 may be varied as desired. As best shown in FIG. 5, the pipes 110 of the support post 108 are spaced apart a distance such that the center plate 96 of the mounting fixtures 90 on each side of the tube 14 may be located adjacent a pipe 110 while the mounting plate 92 is located adjacent the exterior surface 26 of the tube 14. Alternately, as shown in phantom in FIG. 5, a support post 126 which comprises a single pipe may be used in place of the support post 108.

A threaded rod 128 extends through the bore 120 in the support post 108 and through the apertures 102 in the center plates 96 located on each side of the support post 108. A threaded nut 130 is threadably attached at each end of the threaded rod 128. The aperture 104 is sufficiently large such that the nut 130 may pass therethrough. The threaded rod 128 and the nuts 130 rigidly secure the mounting fixtures 90 to the support post 108. A threaded rod 128 similarly extends through the bore 122 in the support post 108 and through the apertures 102 in the center plates 96 of the fixtures 90 located on each side of the support post 108 and rigidly secures the fixtures 90 to the support post 108 with nuts 130. When the support post 126 is used in place of the support post 108, the threaded rod 128 and nuts 130 will clamp the second edge 100 of the side plates 94 against the support post 126. When the support post 126 is used, the length of the side plates 94 between the edges 98 and 100 may be varied to locate the mounting plate 92 adjacent to the exterior surface 26 of the tube 14.

As shown in FIGS. 1, 3 and 5, articles such as gate panels 140 may be attached to the gate column 10G as well as the fence panels 70 or wall panels 72. As with the line column 10L various other articles may be attached to the gate column 10G as desired. The gate panel 140 includes an upper rail 142 and a lower rail 144. The gate panel 140 also includes a plurality of vertical pickets 146 which extend between and are attached to the upper rail 142 and the lower rail 144. The rails 142 and 144 of the gate panel 140 are pivotally attached to a respective plate 148 by hinges 150. The gate panel 140 may take various different forms from that described herein. The plate 148 is connected to the mounting plate 92 of the mounting fixture 90 by fasteners 152 which extend through the plate 148 and the apertures 106 in the mounting plate 92. The fasteners 152 may include any mechanism for fastening such as bolts and nuts or self-drilling, self-tapping screws. The plate 148 may also be attached to the mounting plate 92 by welding. As shown in FIG. 5, the plate 80 of the fence panel 70 is also attached to the mounting plate 92 by fasteners 152. Although not shown, various articles may also be attached to the tube 14 of the gate column 10G by fastening to the mounting strips 42 as with the line column 10L, for example, where the gate column 10G is used at the corner of a fence enclosure.

The gate column 10G is installed by boring a hole in the ground 12 and filling the hole with concrete to form the footing 124. The bottom end 112 of the pipes 110 are inserted into the concrete footing 124. The apertures 88 are then cut through the wall of the tube 14 on diametrically opposite sides of the tube 14 to correspond to the locations of the bores 120 and 122 which extend through the support post 108. The tube 14 is then placed over the support post 108 to rest upon the footing 124. The side plates 94 of the mounting fixtures 90 are then slid into the apertures 88 until the center plates 96 abut the support post 108 and the mounting plate 92 abuts the exterior surface 26 of the tube 14. The threaded rod 128 is then passed through the aperture 104 in the mounting plate 92, through the aperture 102 in the center plate 96, and through the bore 120 in the support post 108 until the threaded rod 128 extends through the aperture 102 in the center plate 96 in the mounting fixture 90 located on the opposite side of the support post 108. The threaded nuts 130 are then passed through the aperture 104 in the mounting plates 92 and are threadably attached to each end of the threaded rod 128. The nuts 130 are then tightened by a socket and ratchet or other tightening means to securely clamp and connect the mounting fixtures 90 to the support post 108 or alternately to the support post 126. Two additional mounting fixtures 90 are similarly connected to the support post 108 by a threaded rod 128 which is inserted through the bore 122 in the support post 108. The gate 140 or other article may then be attached to the mounting plates 92 by the fasteners 152.

While four mounting fixtures 90 are shown in FIG. 2 for attachment to the support post 108, additional mounting fixtures 90 may be connected to the support post 108 as desired with the provision of additional bores through the support post 108 and additional apertures 88 in the tube 14. Alternatively, only two mounting fixtures 90 may be attached to the support post 108.

The loads from the gate 140 or other supported article are transferred by the fasteners 152 to the mounting fixtures 90. The mounting fixture 90 then transfers the load directly to the support post 108 or 126 by the threaded rods 128 and nuts 130. The support post 108 or 126 then transfers the load to the footing 124. The tube 14 of the gate column 10G therefore does not bear any of the load exerted by the supported articles. The gate column 10G therefore is able to support articles which exert greater loads than can be supported by the line column 10L.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A column assembly for supporting an article, said column assembly comprising:

a tube having an interior surface and an exterior surface, said tube including an axial bore;

a wire frame disposed within a wall of said tube, said frame having an interior side and an exterior side, spaced from said interior;

a filler means disposed between said interior side and said exterior side of said frame;

a rigid coating provided on said exterior side of said frame; and mounting means positioned between said interior and exterior sides of said frame adapted to provide a mounting surface for attachment of articles to be supported to said column assembly.

2. The column assembly of claim 1 wherein said mounting means comprises a metal strip.

3. The column assembly of claim 1 additionally including an acrylic surface coating applied on said rigid coating.

4. The column assembly of claim 1 wherein said rigid coating comprises a cementitous material.

5. The column assembly of claim 1 additionally including a plurality of mounting fixtures adapted to be inserted into said wall of said tube, said mounting fixtures adapted to receive and support the article to be supported.

6. The column assembly of claim 5 additionally including a support post positionable within said axial bore of said tube.

7. The column assembly of claim 6 wherein said support post includes a plurality of spaced apart and parallel pipes.

8. The column assembly of claim 6 additionally including means for fastening said mounting plates to said support post.

9. A column assembly for supporting an article, said column assembly comprising:

a tube having an interior surface and an exterior surface, said interior surface defining an axial bore extending through said tube;

a support post insertable within said bore of said tube;

a plurality of mounting fixtures adapted to be inserted into the wall of said tube; and means for fastening said mounting fixtures to said support post, whereby the article to be supported may be attached to said mounting fixture for support by said support post.

10. The column assembly of claim 9 wherein said support post includes a plurality of spaced apart parallel pipes.

11. The column assembly of claim 9 wherein each said mounting fixture includes an exterior plate having a first aperture therein and an interior plate spaced apart and parallel to said exterior plate, said interior plate including a second aperture.

12. The column assembly of claim 9 wherein said tube comprises:

a wire frame;

a filler material disposed within said wire frame; and a rigid coating.

* * * * *